US006213784B1

(12) United States Patent
Cairoli et al.

(10) Patent No.: US 6,213,784 B1
(45) Date of Patent: Apr. 10, 2001

(54) ELECTRICAL CONNECTOR

(75) Inventors: Joseph Cairoli, Tewksbury; Carl Hawkins, West Orange; Luis Miguel Medina, Green Brook, all of NJ (US)

(73) Assignee: National Starch and Chemical Investment Holding Corporation, Wilmington, DE (US)

( * ) Notice: Subject to any disclaimer, the term of this patent is extended or adjusted under 35 U.S.C. 154(b) by 0 days.

(21) Appl. No.: 09/571,605

(22) Filed: May 15, 2000

(51) Int. Cl.[7] ..... H01R 13/60
(52) U.S. Cl. ..... 439/42
(58) Field of Search ..... 439/41, 42

(56) References Cited

U.S. PATENT DOCUMENTS 3,325,639 * 6/1967 King ..... 439/41
3,411,125 * 11/1968 Hill ..... 439/41
3,783,432 * 1/1974 Biba et al. ..... 439/41
3,784,952 * 1/1974 Murray ..... 439/41
4,685,752 8/1987 Costar et al. ..... 439/96

* cited by examiner

*Primary Examiner*—Paula Bradley
*Assistant Examiner*—Tho D. Ta
(74) *Attorney, Agent, or Firm*—Jane E. Gennarp

(57) ABSTRACT

Provides an electrical connector for the cathodic protection of a metallic surface that is subject to corrosion. A layer of insulative adhesive, layer of conductive adhesive and a suction cup are provided so as to permit the electrical connector to be adhesively secured to the metallic surface. This permits cathodic protection of the metallic surface under all corrosive conditions and provides good conductivity.

2 Claims, 1 Drawing Sheet

ELECTRICAL CONNECTOR

FIELD OF THE INVENTION

Figure 1:
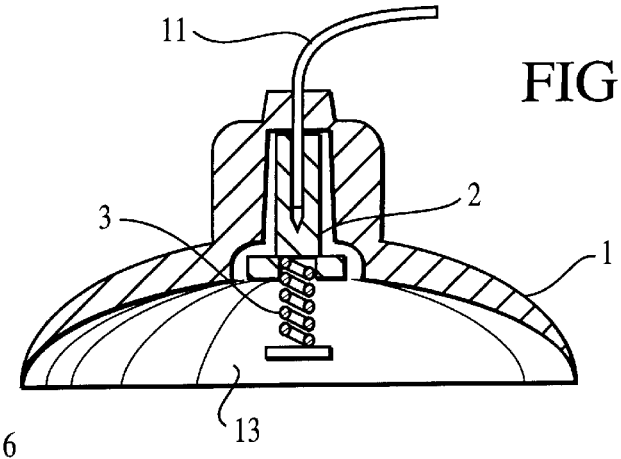

The invention relates to a device for the cathodic protection of various metallic structures, and, more specifically, to non-puncturing and low-temperature physically attachable electrical connectors for the protection of metallic structures.

The invention can be used in systems for anti-corrosion cathodic protection of metallic structures, for example, underground main pipelines, as well as for electric protection of metal objects, including those of a complex shape, from external voltages.

BACKGROUND OF THE INVENTION

Flammable liquids and gases are commonly stored in or transmitted through metallic structures such as tanks and pipelines, and, especially in electrolytic environments (such as soils, moisture, etc.) such metallic structures have a tendency to corrode.

One of the most deleterious forms of corrosion of metal structures occurs when these structures are exposed to the electrolytic action of a conductive environment. While not wishing to be bound by any particular theory, it is believed that electrochemical corrosion results from the flow of current from one area of the metal structure (anodic area), through the conductive environment, to another area on the same structure (cathodic area), thereby completing the circuit of a miniature electrolytic cell. At the anodic areas, the metal is oxidized to a positive valence state and leaves the surface in ionic form, ultimately leading to pitting and other forms of gross degradation of the metal. Electrochemical corrosion is generally encountered when metal structures such as tanks and pipelines are buried in the ground or when such structures as ship hulls and off-shore platforms are submerged in sea water. In order to limit corrosive effects under these circumstances, methods for cathodic protection of metal structures have been developed which rely on an external current source or a sacrificial anode to impose a negative electrical potential on the metal structure relative to its surroundings. This is believed to effectively turn the whole structure into a cathode, thereby reducing, or eliminating, current flow from the structure to the conductive environment, and thus the corrosion associated therewith.

Cathodic protection might entail the connection of an elongated electrically conductive wire between a storage tank or transmission pipeline metallic structure and the external source of electrons. The electrons source might be an electrical generator apparatus or even simply an anodic chemical element (e.g. magnesium, zinc, etc.) having an empirical rating on the "Electromotive Force Series of Metals" (i.e. EMS) that is relatively higher than is the EMS rating for the metallic structure. However, as is appreciated in the prior art, connecting the elongate wire to a tank or pipeline metallic structure invariably necessitates the very expensive fire-prevention step of initially purging the flammable fluid prior to making a mechanical or high-temperature connection to the tank or pipeline. For example, mechanical connections deliberately puncture the tank or pipeline, and welds or chemically exothermic processes are apt to produce hairline cracks in the metallic tank or piping; in either case, the escaping flammable fluid can ignite to endanger the workers and environs.

Some examples of metallic structures which are prone to the phenomenon of spontaneous corrosion are: radiating panels embedded in floor concrete; metallic pipes embedded in or passing through masonry; and standing, fixedly mounted metallic piles. All of these metallic structures may come into contact with water or some other electrolyte. Moreover, metallic structures which are exposed to the atmosphere are also susceptible to spontaneous corrosion. For instance, eaves, gutters, motor vehicle parts etc. are all subject to this phenomenon.

Other prior art methods of connecting a cathodic protection device to a metallic structure include the method described in U.S. Pat. No. 4,685,752 (MATERIALS PROTECTION COMPANY) wherein the cathodic protection device is attached to a metallic surface by an adhesive and conductive contact is then achieved by turning a screw cap, having an electrically conductive terminal member attached thereto, in a downward direction until contact is made between the terminal member and the metallic surface.

Unlike the prior art, this invention provides cathodic protection devices that are easily and quickly connected to metallic surfaces. These devices comprise a suction cup and adhesive(s). The suction cup allows the cathodic protection device to be quickly attached to a metallic surface and, without the requirement for any other action, provides the device with sufficient residence time on the surface to allow the adhesive(s) to bond the cathodic protection device to the metallic surface.

SUMMARY OF THE INVENTION

This invention provides an electrical connector for the cathodic protection of a metallic surface that is subject to corrosion. A layer of insulative adhesive and a layer of conductive adhesive and a suction cup are provided so as to permit the electrical connector to be adhesively secured to the metallic surface. This permits cathodic protection of the metallic surface under all corrosive conditions and provides good conductivity.

The electrical connector of the present invention comprises:

(a) a suction cup having a contact end, a non-contact end, at least one central opening and at least one housing portion within the central opening;

(b) an electrically conductive contact member within the housing portion of the suction cup having a contact end extending into the central opening of the suction cup and a non-contact end;

(c) a cable conductor attached to the electrically conductive contact member through the non-contact end;

(d) an electrically conductive terminal member attached to the contact-end of the electrically conductive contact member and extending from the housing portion via the contact end of the central opening;

(e) an electrically insulative adhesive carried by and extending around the contact end of the suction cup;

(f) an electrically conductive adhesive surrounded by the insulative adhesive and carried by the contact end of the suction cup.

DETAILED DESCRIPTION

The electrical connector of this invention is physically attachable to the external surface of a metallic structure by virtue of an electrically insulative adhesive and an electrically conductive adhesive that adhere along the lower-side, relative to a cable conductor, of a suction cup. Disposed within the suction cup are at least one electrically conductive contact member and at least one electrically conductive terminal member, whereby the electrically conductive terminal member makes electrically conductive abutment with the external surface of a suitable metallic structure.

A cable conductor member, which might for example be connected to a remote source of electrons, is in electrically conductive relationship to said electrically conductive contact member.

The electrical connector of the present invention comprises: a suction cup having at least one central opening and at least one housing portion within the central opening; an electrically conductive contact member within the housing portion of the suction cup; a cable conductor attached to the electrically conductive contact member through the upper-side of the central opening of the suction cup; an electrically conductive terminal member attached to the lower-side, relative to the cable conductor, of the electrically conductive contact member and extending from the housing portion via the lower-side, relative to the cable conductor, of the central opening; an electrically insulative adhesive carried by and extending around the edge of the underside, relative to the cable conductor, of the suction cup; an electrically conductive adhesive surrounded by the insulative adhesive and carried by the underside, relative to the cable conductor, of the suction cup.

The electrically conductive terminal member is preferably co-elevational with the electrically insulative adhesive and electrically conductive adhesive and should be in electrically conductive surface abutment with the metallic structure being protected. Preferably, the electrically conductive terminal member is a conductive metallic helical spring.

The electrically conductive contact member and the electrically conductive terminal member may be made from any electrically conductive material. Preferably the electrically conductive material is copper or aluminum.

The electrically insulative and electrically conductive adhesives of this invention are preferably waterproof, resistant to the action of petroliferous products or hydrocarbons, resistant to chemical action, weather-resistant and heat-resistant. These characteristics make it particularly feasible to use the electrical connector according to the invention directly on all parts of the metallic surface to be protected.

Examples of electrically conductive adhesives are acrylic glues or vinyl glues which have been suitably treated to make them conductive. A typical electrically conductive adhesive is LX901-118 ( a conductive epoxy available from TRA-CON).

The insulative adhesive may be self-adhesive immediately (e.g. a contact adhesive). On the other hand, it is also possible for the adhesive to be present in dry form. When in dry form, the adhesive may be activated, that is, made adhesive, by wetting it with a suitable liquid such as, for instance, water, or the adhesive may be activated by heating it or by subjecting it to the action of luminous energy. Typical insulative adhesives include contact adhesives such as CA799LV (a contact adhesive available from PERMABOND).

Referring to the drawings, FIG. 1 shows an electrical connector of this invention. The electrical connector includes a suction cup 1 having a central opening 13 and a housing portion 4 within the central opening.

An electrically conductive contact member 2 is press fit into the housing portion 4 of the suction cup 1. Preferably electrically conductive contact member 2 is made from copper or aluminum. Electrically conductive contact member 2 is positioned in the housing portion 4 to have a first end in contact with the upper-side of the housing portion 4 and a second end at the lower-side, relative to the cable conductor 11, of the housing portion 4 facing the open end of suction cup 1.

Figure 2:
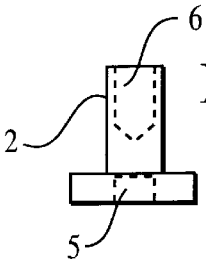

As shown in FIG. 2 a central aperture 5 is provided in electrically conductive contact member 2 and, as shown in FIG. 1, extends into the member from the second end facing the open end of the suction cup 1. A second central aperture 6 is provided in electrically conductive contact member 2 and, as shown in FIG. 1, extends into the member from the first end in contact with the upper-side of the housing portion 4 of suction cup 1.

Figure 3:
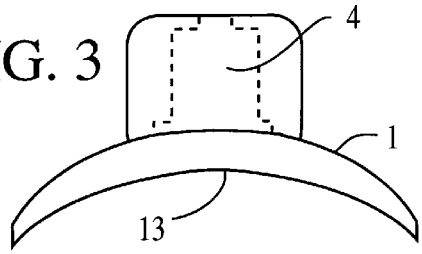

FIG. 3 shows the housing portion 4 of the suction cup 1.

As can be seen in FIG. 1 a cable conductor 11 is provided to connect to electrically conductive contact member 2. Cable conductor 11 may be made with a conventional electrically conductive metal core material such as copper or aluminum surrounded by an insulating material such as a plastic or synthetic rubbers. Insulating material is removed from one end of cable conductor 11 to expose electrically conductive metal so it can be inserted in aperture 6 of electrically conductive contact member 2 and welded or soldered or otherwise attached thereto by conventional means.

In FIG. 1, the electrically conductive terminal member 3 is represented by a conductive contact member, particularly a conductive metallic helical spring. Electrically conductive terminal member 3 is inserted in aperture 5 of conductive contact member 2 and may be attached thereto by a conductive adhesive. As shown in FIG. 1 the electrically conductive terminal member 3 extends downwards from housing member 4 into the underside, relative to the cable conductor 11, of suction cup 1.

Figure 4:
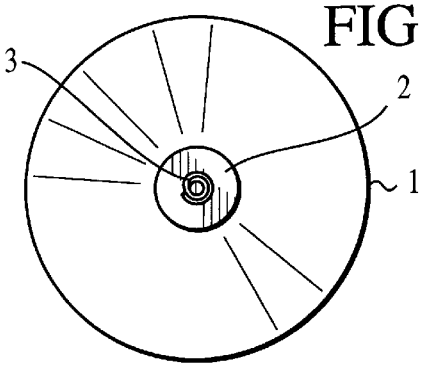

FIG. 4 shows the position of conductive contact member 2 and electrically conductive terminal member 3 within the underside, relative to the cable conductor 11, of suction cup 1 prior to appliance of adhesives.

Figure 5:
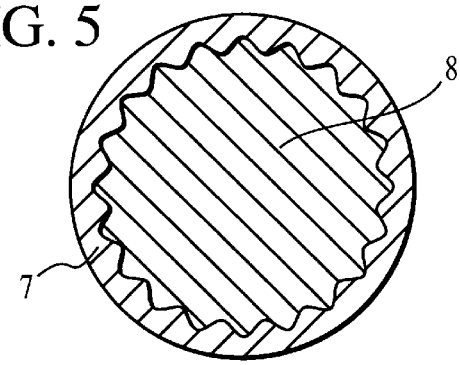

FIG. 5 shows the underside, relative to the cable conductor 11, of suction cup 1 with a layer of insulative adhesive 7 placed around the outside edge and conductive adhesive 8 covering the remainder of the underside area.

Figure 6:
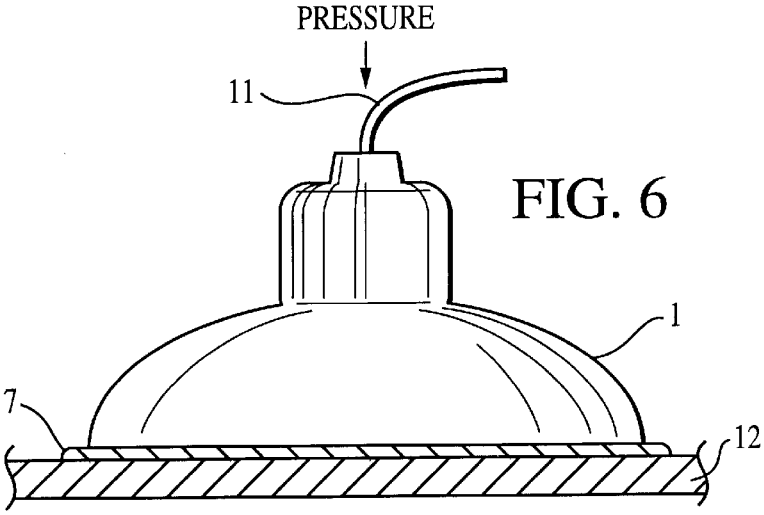

As represented in FIG. 6, the electrical connector may be connected to a metallic surface 12, such metallic surfaces may be of varying sizes and shapes including linear surfaces, allowing for flexibility in design, by applying downward pressure on suction cup 1 until insulative adhesive layer 7 forms a bond with the metallic surface 12.

We claim:

1. An electrical connector comprising:

(a) a suction cup having a contact end, a non-contact end, at least one central opening and at least one housing portion within the at least one central opening;

(b) an electrically conductive contact member having a contact end extending into the at least one central opening of the suction cup and a non-contact end within the at least one housing portion of the suction cup;

(c) a cable conductor attached to the electrically conductive contact member through the non-contact end of the electrically conductive contact member;

(d) an electrically conductive terminal member attached to the contact-end of the electrically conductive contact member and extending from the at least one housing portion via the contact end into the at least one central opening;

(e) an electrically insulative adhesive carried by and extending around the contact end of the suction cup; and (f) an electrically conductive adhesive surrounded by the insulative adhesive and covering the remainder of the contact end of the suction cup.

2. The electrical connector of claim 1 wherein the electrically conductive terminal member is a conductive metallic helical spring.

* * * * *